US005901577A

United States Patent [19]

Pelle et al.

[11] Patent Number: 5,901,577

[45] Date of Patent: May 11, 1999

[54] PROCESS AND PLANT FOR AIR SEPARATION BY CRYOGENIC DISTILLATION

[75] Inventors: Martine Pelle, Ozoir-La-Ferriere; Norbert Rieth, Paris, both of France

[73] Assignee: L'Air Liquide, Societe Anonyme Pour L'Etude et L'Exploitation des Procedes Georges Claude, Paris Cedex, France

[21] Appl. No.: 09/053,133

[22] Filed: Apr. 1, 1998

[30] Foreign Application Priority Data

Apr. 3, 1997 [FR] France ..... 97 04083

[51] Int. Cl.[6] ..... F25J 3/04

[52] U.S. Cl. ..... 62/646; 62/910

[58] Field of Search ..... 62/645, 646, 910

[56] References Cited

U.S. PATENT DOCUMENTS 5,564,290 10/1996 Bonaquist et al. ..... 62/646
5,600,970 2/1997 Drnevich et al. ..... 62/651

*Primary Examiner*—Christopher B. Kilner
*Attorney, Agent, or Firm*—Young & Thompson

[57] ABSTRACT

A process and plant for air separation by cryogenic distillation. Air is cooled in a main exchanger and is sent to a distillation column in which it separates into an oxygen-enriched liquid and a nitrogen-enriched vapor. A stream of pressurized liquid coming from the apparatus vaporizes in the main exchanger. The refrigeration necessary for the process is generated by expansion of air in one or more turbines immediately downstream of the main exchanger. The turbine or turbines produces or produce, as output, a stream which is at least 95 percent liquid, preferably 100 percent liquid.

15 Claims, 4 Drawing Sheets

PROCESS AND PLANT FOR AIR SEPARATION BY CRYOGENIC DISTILLATION

FIELD OF THE INVENTION

The present invention relates to a process and a plant for air separation by cryogenic distillation.

BACKGROUND OF THE INVENTION

Air separation by cryogenic means involves the use of cold generation and of a cold source.

It is known to expand, with external work, gases under pressure which are introduced into an expansion machine at temperatures appreciably above their dew point.

FR-A-2,335,809 describes a single-turbine apparatus which provides the process with all the necessary refrigeration. The gas expanded in the turbine may be medium-pressure nitrogen or air. Overpressurized air is liquefied by heat exchange with liquid oxygen under pressure, which vaporizes.

U.S. Pat. No. 5,564,290 describes a process in which pressurized air, condensed by the vaporization of pumped liquid oxygen, then vaporizes in a turbine so as to produce a two-phase flow.

It is also known to keep an apparatus cold, at least partially, by feeding cryogenic liquids into distillation columns.

Known hydraulic turbines produce a fluid which is generally in liquid form.

SUMMARY OF THE INVENTION

The object of the present invention is to improve the energy performance of the known apparatuses.

The invention provides a process for air separation by cryogenic distillation, in which air is cooled in a main exchanger and is sent to a distillation column of an apparatus comprising at least one distillation column in which it separates into an oxygen-enriched liquid and a nitrogen-enriched vapour, and a stream of pressurized liquid coming from the apparatus vaporizes in the main exchanger, the refrigeration necessary for the process being generated by expansion of a heat-generating fluid in one or more turbines, characterized in that the turbine or all the turbines of the apparatus produces or produce, as output, a stream which is at least 95% liquid, especially 100% liquid.

According to other aspects of the invention, a process is provided in which:

the heat-generating fluid enters the turbine(s) in liquid form or at a pressure above the supercritical pressure;

the heat-generating fluid entering the turbine(s) comes from the cold end of the main exchanger;

the heat-generating fluid is air or a fluid coming from the separation apparatus;

the pressurized liquid is enriched with oxygen, with nitrogen or with argon;

the turbine constitutes the only turbine of the apparatus;

two turbines successively expand the same heat-generating fluid;

the apparatus comprises a double column, consisting of a medium-pressure column and a low-pressure column;

the apparatus also comprises an argon column fed with an argon-enriched stream coming from the low-pressure column; and the stream expanded in the turbine(s) is sent to the medium-pressure column and/or to the low-pressure column.

A single hydraulic turbine allows the system to be kept cold without the aid of a turbine which expands gas at a pressure below the supercritical pressure. This reduction in investment is made possible by improving the performance of the plate exchangers (minimal $\Delta T$ between 2° C. and 1° C.), hence low losses by difference and because of the improved efficiency of recent-generation hydraulic turbines.

The invention also provides a plant for air separation by cryogenic distillation, which comprises:

at least one distillation column, a heat exchanger, means for sending air to the heat exchanger and from the heat exchanger to a distillation column, means for withdrawing a liquid from a distillation column and for pressurizing this liquid, means for sending the pressurized liquid to the heat exchanger, one or more expansion turbines fed with a heat-generating fluid, characterized in that the only turbine (or the only turbines) of the plant is (or are) capable of producing, as output, a stream which is at least 95% liquid.

The invention proves to be particularly advantageous in the case in which there is argon production, as it improves the reflux rate inside the main column.

In the case in which the heat-generating fluid intended for the hydraulic turbine is from the cold end of the exchanger, this allows a reduction in the manufacturing cost of the exchanger.

Examples of implementation will now be described with regard to the appended drawings, in which:

DESCRIPTION OF THE PREFERRED EMBODIMENTS

Figure 1:
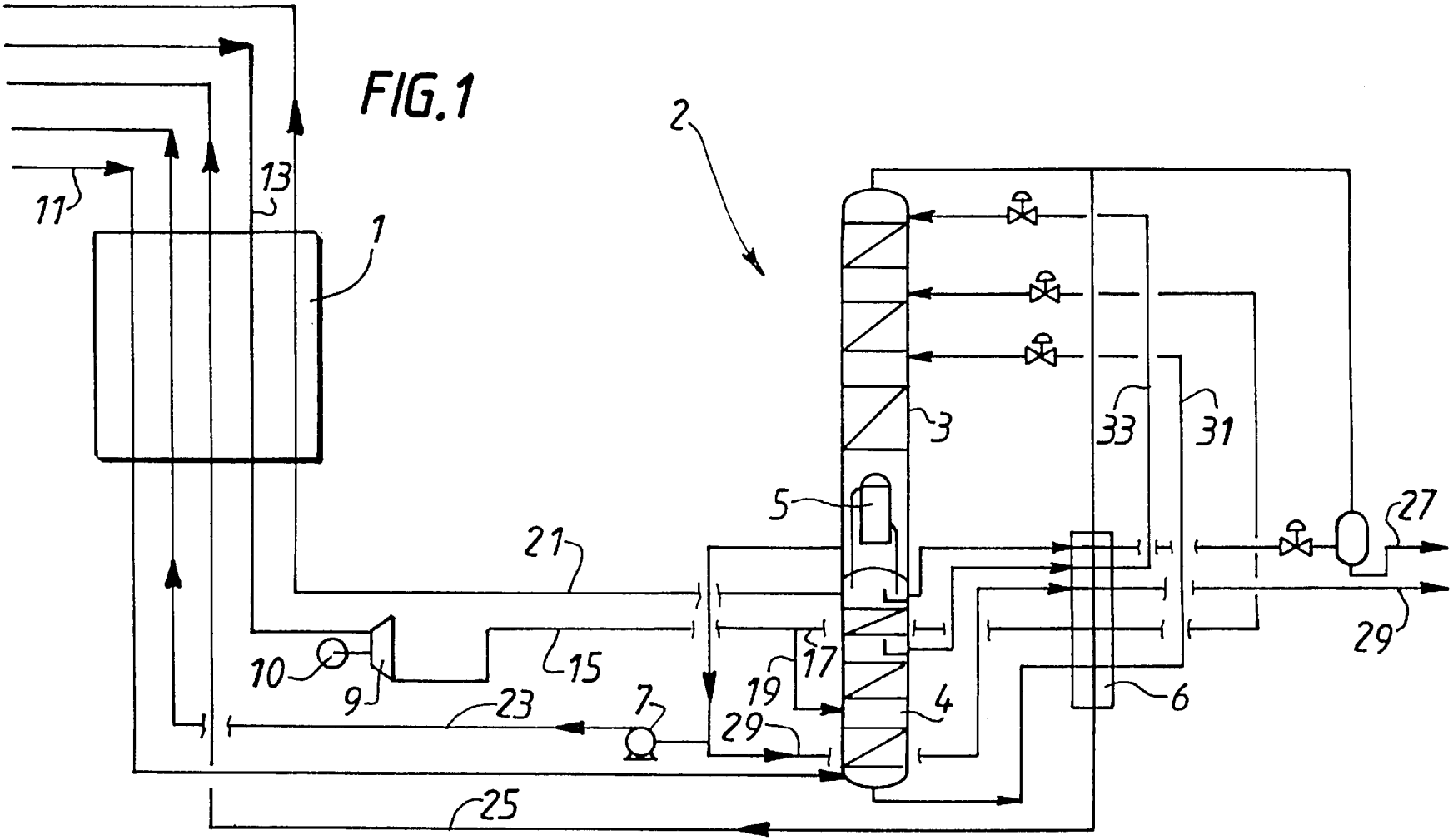
FIGS. 1 to 4 represent, respectively and diagrammatically, four embodiments according to the invention.

The plant for production of gaseous oxygen under pressure, shown in FIG. 1, essentially comprises a heat-exchange line 1 intended to cool the air to be treated by countercurrent indirect heat exchange with cold products, an air distillation apparatus 2 of the double-column type, essentially consisting of a medium-pressure column 4 on top of which is a low-pressure column 3, with a reboiler/condenser 5 which brings, into an indirect heat-exchange relationship, the vapour (nitrogen) at the top of the column 4 and the liquid (oxygen) in the collector of the column 3, a subcooler 6, an air expansion turbine 9 and a liquid-oxygen pump 7.

Air 11 to be treated, at between 5 and 7 bar, enters the exchange line 1 and is cooled down to approximately its dew point. This air then enters the medium-pressure column 5 where it is separated into a "rich liquid" (oxygen-enriched air) and into nitrogen. The rich liquid 31 and the liquid nitrogen 33 withdrawn from the top of the column 4 are subcooled in the subcooler 6 by the low-pressure impure nitrogen 25 produced at the top of the column 3 and then, after expansion in expansion valves, respectively feed this low-pressure column 3. After warming up in 6 and then in 1, the low-pressure impure nitrogen, at ambient temperature, may be used to regenerate a purification apparatus.

The rest of the air 13 (constituting approximately 30% of the air) is overpressurized to between 7 and 100 bar and is cooled by passing right through the exchange line 1, hence it leaves either in liquid form or in the form of dense gas if its pressure exceeds 36 bar.

This air 13 is expanded at the medium pressure in the turbine 9 so as to form a liquid stream.

Some of the liquid 19 is sent to the medium-pressure column 4 and the rest 17 is expanded in a valve, before being sent to the low-pressure column 3.

The production oxygen is withdrawn in liquid form from the collector of the low-pressure column 3, brought in 7 to the production pressure (between 1.8 and 100 bar), vaporized by heat exchange with the air 13, warmed up to ambient temperature and recovered in gaseous oxygen form via a pipe 23.

Moreover, gaseous nitrogen withdrawn from the top of the column 4 is, after warming up in 1, recovered via a pipe 21.

Also indicated in FIG. 1 are a liquid-nitrogen production pipe 27 and a liquid-oxygen production pipe 29.

The turbine 9 is decelerated by an alternator 10 but may also be decelerated by other means. Likewise, the wheel of the turbine 9 may be keyed onto the same shaft as that of the pump 7.

Figure 2:
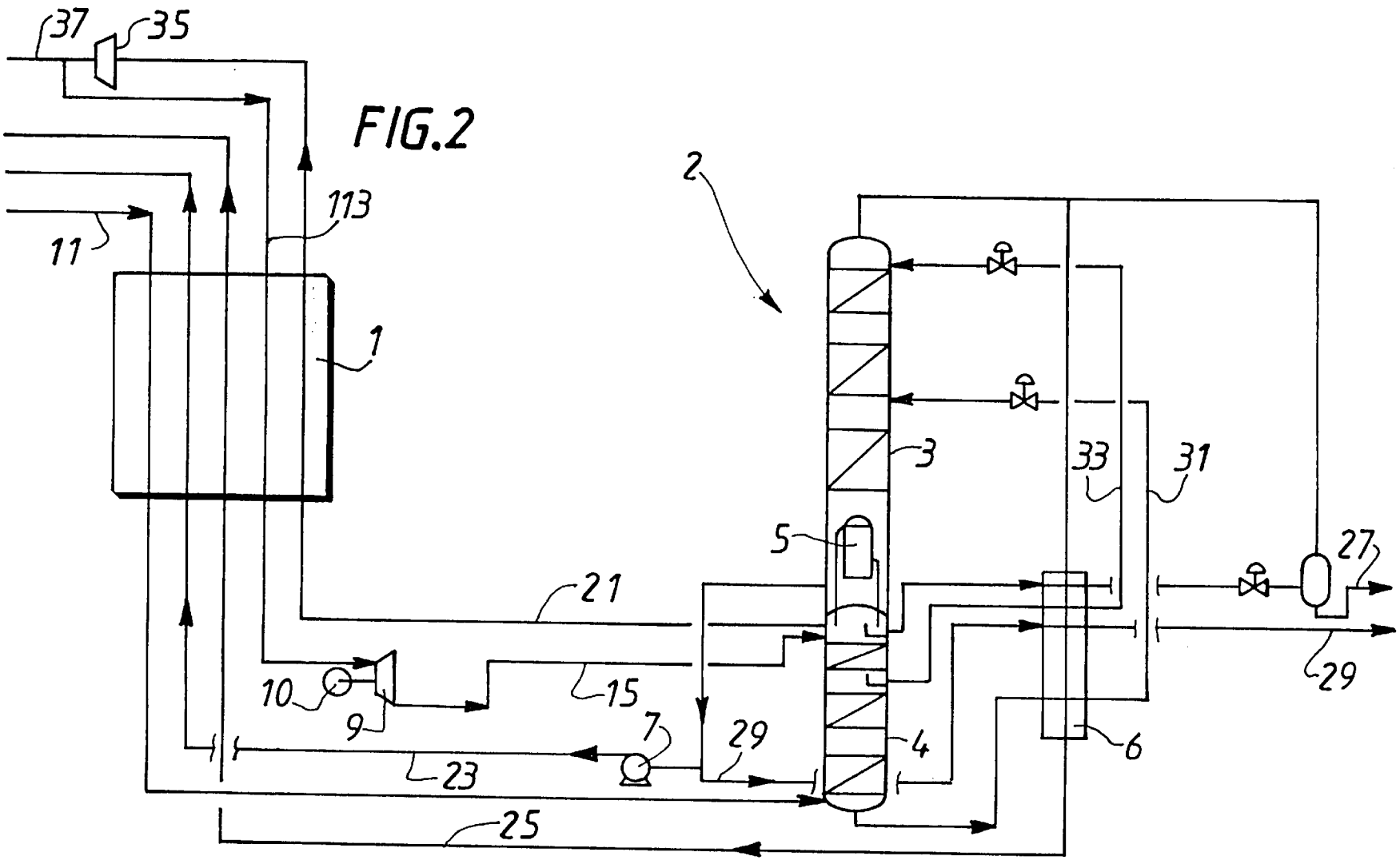

The plant shown in FIG. 2 differs from that of FIG. 1 only by the fact that the heat-generating fluid feeding the turbine 9 is nitrogen 21 withdrawn from the column 4, compressed by the compressor 35 at between 7 and 100 bar after warming up to ambient temperature and cooled in 1 in order to become liquid or at a supercritical pressure at the input of the turbine 9. The liquid thus produced after expansion in the turbine 9 is sent to the top of the medium-pressure column 4.

This arrangement makes it possible to produce a high-pressure nitrogen stream 37.

Figure 3:
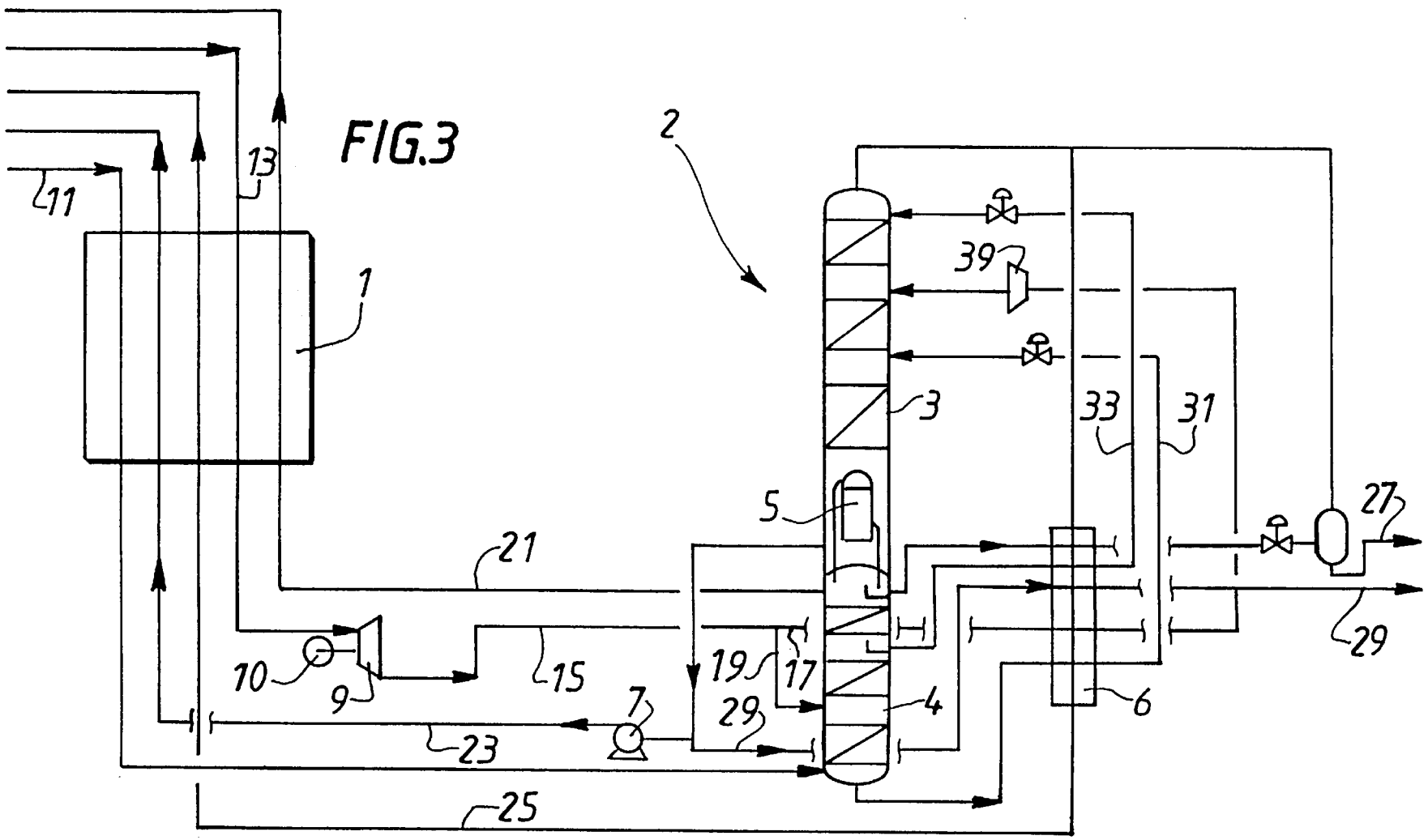

The plant shown in FIG. 3 differs from that of FIG. 1 only in that it comprises two hydraulic turbines 9, 39. The turbine 39 replaces the valve in the line 15 and is fed with liquid coming from the output of the turbine 9.

Figure 4:
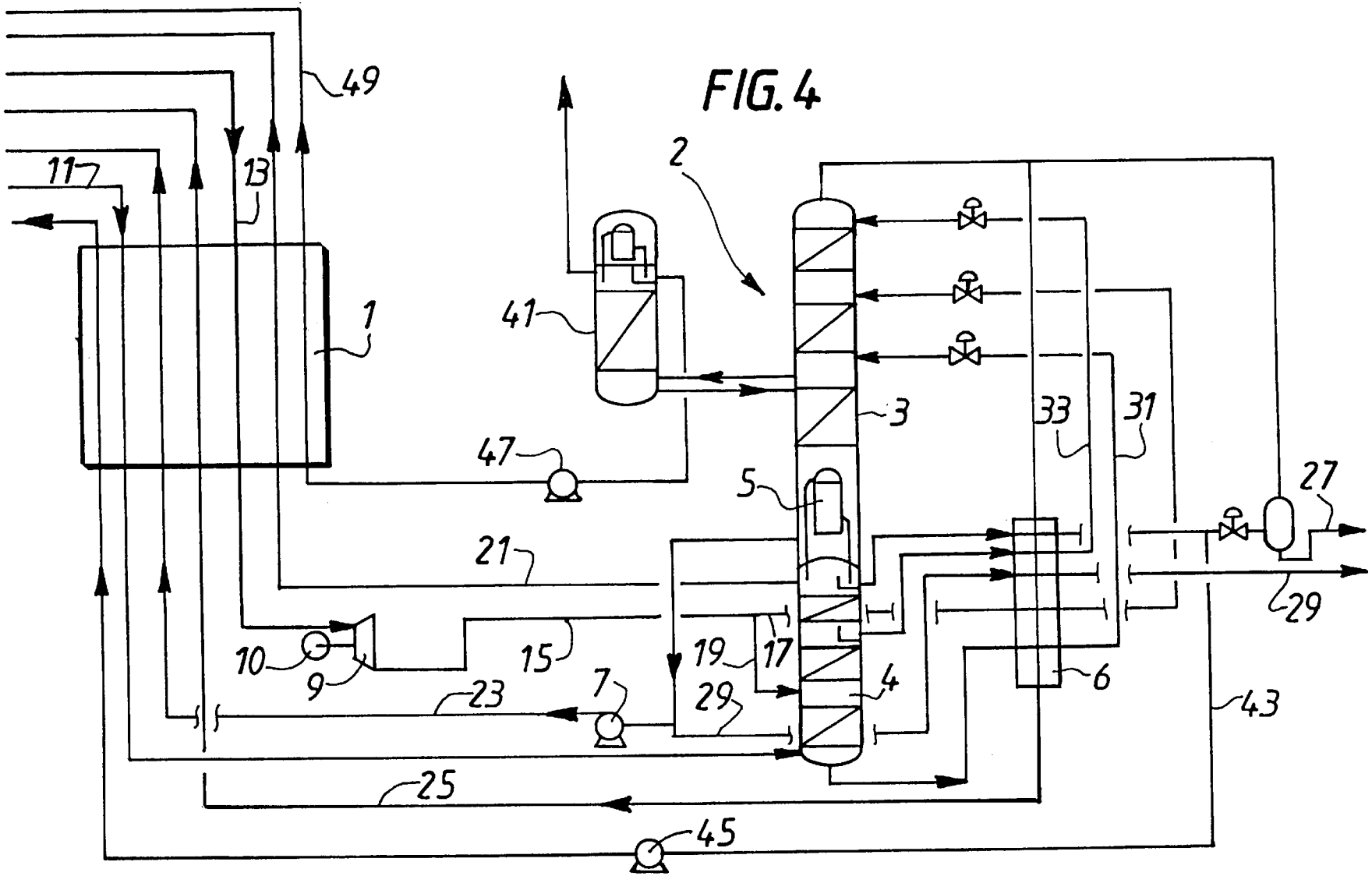

The plant shown in FIG. 4 differs from that of FIG. 1 only in that it comprises an argon column 41 and liquid-argon and liquid-nitrogen pumps 47, 45.

In order to simplify the drawing, the rich-liquid line used to cool the condenser at the top of the argon column has not been shown.

It is also conceivable to provide two hydraulic turbines in order to provide the refrigeration, one of which expands an air stream and the other the cycle nitrogen stream.

We claim:

1. Process for air separation by cryogenic distillation, in which air is cooled in a main exchanger (1) and is sent to a distillation column of an apparatus comprising at least one distillation column in which it separates into an oxygen-enriched liquid and a nitrogen-enriched vapor, and a stream of pressurized liquid coming from the apparatus vaporizes in the main exchanger, the refrigeration necessary for the process being generated by expansion of air in one or more turbines (9, 39), characterized in that the turbine or all the turbines of the apparatus produces or produce, as output, a stream which is at least 95% liquid.

2. Process according to claim 1, in which the air entering the turbine(s) comes from the cold end of the main exchanger (1).

3. Process according to claim 1, in which the pressurized liquid is enriched with oxygen, with nitrogen or with argon.

4. Process according to claim 1, in which the turbine (9) constitutes the only turbine of the apparatus.

5. Process according to claim 1, in which two turbines successively expand the same air.

6. Process according to claim 1, in which the apparatus comprises a double column consisting of a medium-pressure column and a low-pressure column.

7. Process according to claim 6, in which the apparatus also comprises an argon column fed with an argon-enriched stream coming from the low-pressure column.

8. Process according to claim 6, in which the stream expanded in the turbine(s) is sent to the medium-pressure column and/or to the low-pressure column.

9. Process according to claim 1, wherein said stream is 100% liquid.

10. Process according to claim 1, wherein said turbine or turbines is or are immediately downstream of said main exchanger.

11. Process according to claim 8, in which a further gaseous air stream is sent to the medium-pressure column at a point at least one theoretical tray above a point of injection of the further gaseous air stream.

12. Plant for air separation by cryogenic distillation, which comprises:

at least one distillation column (2), a heat exchanger (1), means for sending air to the heat exchanger and from the heat exchanger to a distillation column, means for withdrawing a liquid from a distillation column, and for pressurizing this liquid, means for sending the pressurized liquid to the heat exchanger, one or more turbines fed with air, characterized in that the only turbine or the only turbines of the plant produces or produce, as output, a stream which is at least 95% liquid.

13. Plant according to claim 12, comprising a double distillation column.

14. Plant according to claim 13, comprising also an argon column.

15. Plant according to claim 12, wherein said turbine or turbines is or are immediately downstream of said heat exchanger.

* * * * *